US010329512B2

(12) United States Patent
Moniz et al.

(10) Patent No.: US 10,329,512 B2
(45) Date of Patent: Jun. 25, 2019

(54) LUBRICATION OIL COMPOSITION WITH ENHANCED WEAR AND LOW SPEED PRE-IGNITION PROPERTIES

(71) Applicants: CHEVRON ORONITE TECHNOLOGY B.V., San Ramon, CA (US); Chevron Oronite Company LLC, San Ramon, CA (US)

(72) Inventors: Menno Anton Stefan Moniz, Rotterdam (NL); Jeroen Van Leeuwen, Rotterdam (NL); John Robert Miller, San Rafael, CA (US)

(73) Assignees: Chevron Oronite Company LLC, San Ramon, CA (US); Chevron Oronite Technology B.V., Rotterdam (NL)

( * ) Notice: Subject to any disclaimer, the term of this patent is extended or adjusted under 35 U.S.C. 154(b) by 0 days.

(21) Appl. No.: 15/444,590

(22) Filed: Feb. 28, 2017

(65) Prior Publication Data

US 2018/0245015 A1 Aug. 30, 2018

(51) Int. Cl.

| | |
|---|---|
| ***C10M 169/04*** | (2006.01) |
| ***C10M 135/10*** | (2006.01) |
| ***C10M 129/50*** | (2006.01) |
| ***C10M 133/44*** | (2006.01) |
| ***C10M 137/10*** | (2006.01) |
| ***C10M 139/00*** | (2006.01) |
| ***C10M 133/12*** | (2006.01) |

(52) U.S. Cl.

CPC ..... *C10M 169/04* (2013.01); *C10M 129/50* (2013.01); *C10M 133/12* (2013.01); *C10M 133/44* (2013.01); *C10M 135/10* (2013.01); *C10M 137/10* (2013.01); *C10M 139/00* (2013.01); *C10M 2207/141* (2013.01); *C10M 2215/064* (2013.01); *C10M 2215/30* (2013.01); *C10M 2219/046* (2013.01); *C10M 2223/045* (2013.01); *C10M 2227/09* (2013.01); *C10N 2230/02* (2013.01); *C10N 2230/04* (2013.01); *C10N 2230/06* (2013.01); *C10N 2230/10* (2013.01); *C10N 2230/12* (2013.01); *C10N 2230/18* (2013.01); *C10N 2240/10* (2013.01)

(58) Field of Classification Search

CPC ..... C10N 2040/25; C10N 2240/10
USPC ..... 508/192
See application file for complete search history.

(56) References Cited

U.S. PATENT DOCUMENTS

| | | | | |
|---|---|---|---|---|
| 3,313,727 | A | 4/1967 | Peeler | |
| 3,819,521 | A | 6/1974 | Sims | |
| 3,853,772 | A | 12/1974 | Adams | |
| 3,997,454 | A | 12/1976 | Adams | |
| 4,089,790 | A | 5/1978 | Adams | |
| 4,259,104 | A | 3/1981 | Edwards | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,283,295 | A | 8/1981 | deVries et al. | |
| 4,285,822 | A | 8/1981 | deVries et al. | |
| 4,369,119 | A | 1/1983 | deVries et al. | |
| 4,370,246 | A | 1/1983 | deVries et al. | |
| 4,394,279 | A | 7/1983 | deVries et al. | |
| 4,402,840 | A | 9/1983 | deVries et al. | |
| 4,584,115 | A | 4/1986 | Davis | |
| 6,534,450 | B1 | 3/2003 | Harrison et al. | |
| 6,737,387 | B2 | 5/2004 | Harrison et al. | |
| 6,962,896 | B2 | 11/2005 | Ruhe, Jr. et al. | |
| 7,026,273 | B2 * | 4/2006 | Robson | C10M 141/12 508/156 |
| 7,884,058 | B2 | 2/2011 | Nelson et al. | |
| 7,906,469 | B2 * | 3/2011 | Arrowsmith | C10M 163/00 508/363 |
| 8,022,022 | B2 | 9/2011 | Nelson et al. | |
| 8,022,023 | B2 | 9/2011 | Nelson et al. | |
| 8,076,275 | B2 | 12/2011 | Ruhe, Jr. et al. | |
| 8,183,189 | B2 | 5/2012 | Chen et al. | |
| 8,193,131 | B2 | 6/2012 | Nelson et al. | |
| 8,193,132 | B2 | 6/2012 | Nelson et al. | |
| 8,426,608 | B2 | 4/2013 | Nelson et al. | |
| 8,476,460 | B2 | 7/2013 | Nelson et al. | |
| 8,513,169 | B2 * | 8/2013 | Diggs | C10M 163/00 508/110 |
| 8,980,806 | B2 | 3/2015 | Bhalla et al. | |
| 2009/0186784 | A1 * | 7/2009 | Diggs | C10M 167/00 508/155 |
| 2010/0152073 | A1 * | 6/2010 | Nelson | C10M 141/12 508/108 |
| 2011/0136711 | A1 | 6/2011 | Wang et al. | |
| 2013/0261313 | A1 | 10/2013 | Nelson et al. | |
| 2014/0018269 | A1 | 1/2014 | Bhalla et al. | |
| 2014/0179573 | A1 | 6/2014 | Tsang et al. | |
| 2015/0307802 | A1 * | 10/2015 | Ritchie | C10M 125/22 508/151 |
| 2015/0322367 | A1 * | 11/2015 | Patel | C10M 129/56 508/186 |
| 2015/0322368 | A1 * | 11/2015 | Patel | C10M 163/00 508/192 |
| 2017/0015927 | A1 * | 1/2017 | Fletcher | C10M 129/50 |
| 2017/0015933 | A1 * | 1/2017 | Fletcher | C10M 169/04 |
| 2017/0022441 | A1 * | 1/2017 | Onodera | C10M 141/12 |

(Continued)

*Primary Examiner* — Ellen M McAvoy
(74) *Attorney, Agent, or Firm* — Carlton Virassammy

(57) ABSTRACT

A lubricating oil composition having a sulfated ash content of from greater than 1.0 wt. % to about 2.0 wt. %, a phosphorus content of from about 0.07 to about 0.12 wt. % and a sulfur content of 0.4 wt. % or less, the lubricating oil composition comprising: (a) an oil of lubricating viscosity in a major amount; (b) an overbased magnesium detergent, in an amount providing the lubricating oil composition with at least 600 ppm of magnesium; (c) a boron-containing compound, in an amount providing the lubricating oil composition with at least 250 ppm of boron; and (d) a molybdenum-containing compound, in an amount providing the lubricating oil composition with at least 50 ppm of molybdenum, wherein the composition has a B/Mo mass ratio in a range of 2 to 10 and a S/Mo mass ratio in a range of 10 to 25.

8 Claims, No Drawings

(56) References Cited

U.S. PATENT DOCUMENTS

| | | | | |
|---|---|---|---|---|
| 2017/0101598 | A1* | 4/2017 | Cant | C10M 129/54 |
| 2017/0204348 | A1* | 7/2017 | Tamura | C10M 169/04 |
| 2017/0247627 | A1* | 8/2017 | Yang | C10M 135/10 |
| 2017/0321146 | A1* | 11/2017 | Fletcher | C10M 141/12 |

* cited by examiner

LUBRICATION OIL COMPOSITION WITH ENHANCED WEAR AND LOW SPEED PRE-IGNITION PROPERTIES

TECHNICAL FIELD

The present disclosure relates to lubricants for internal combustion engines, particularly those for spark-ignited direct injection engines.

BACKGROUND

Modern engine designs are being developed to improve fuel economy without sacrificing performance or durability. Historically, gasoline was port-fuel injected (PFI), that is, injected through the air intake and entering the combustion chamber via the air intake valve. Gasoline direct injection (GDI) involves direct injection of gasoline into the combustion chamber.

In certain situations, the internal combustion engine may exhibit abnormal combustion. Abnormal combustion in a spark-initiated internal combustion engine may be understood as an uncontrolled explosion occurring in the combustion chamber as a result of ignition of combustible elements therein by a source other than the igniter.

Pre-ignition may be understood as an abnormal form of combustion resulting from ignition of the air-fuel mixture prior to ignition by the igniter. Anytime the air-fuel mixture in the combustion chamber is ignited prior to ignition by the igniter, such may be understood as pre-ignition.

Without being bound to a particular theory, traditionally, pre-ignition has occurred during high speed operation of an engine when a particular point within the combustion chamber of a cylinder may become hot enough during high speed operation of the engine to effectively function as a glow plug (e.g., overheated spark plug tip, overheated burr of metal) to provide a source of ignition which causes the air-fuel mixture to ignite before ignition by the igniter. Such pre-ignition may be more commonly referred to as hot-spot pre-ignition, and may be inhibited by simply locating the hot spot and eliminating it.

More recently, vehicle manufacturers have observed intermittent abnormal combustion in their production of turbocharged gasoline engines, particularly at low speeds and medium-to-high loads. More particularly, when operating the engine at speeds less than or equal to 3000 rpm and under a load with a break mean effective pressure (BMEP) of greater than or equal to 10 bars, a condition which may be referred to as low-speed pre-ignition (LSPI) may occur in a very random and stochastic fashion.

The presently disclosed engine oil lubricant is suitable for reducing, inhibiting, or even eliminating LSPI events in direct injection engines by operating the engines with a lubricant that contains an overbased sodium detergent. Moreover, the present engine oil lubricant has a composition sufficient to pass wear protection requirements of one or more engine tests selected from Sequence IVA (ASTM D6891), OM646LA (CEC L-99-08) and M271.

SUMMARY

In one aspect, there is a lubricating oil composition having a sulfated ash content of from greater than 1.0 wt. % to about 2.0 wt. %, a phosphorus content of from about 0.07 to about 0.12 wt. % and a sulfur content of 0.4 wt. % or less, the lubricating oil composition comprising: (a) an oil of lubricating viscosity in a major amount; (b) an overbased magnesium detergent, in an amount providing the lubricating oil composition with at least 600 ppm of magnesium, based on the total weight of the lubricating oil composition; (c) a boron-containing compound, in an amount providing the lubricating oil composition with at least 250 ppm of boron, based upon the total weight of the composition; and (d) a molybdenum-containing compound, in an amount providing the lubricating oil composition with at least 100 ppm of molybdenum, based upon the total weight of the composition, wherein the composition has a B/Mo mass ratio in a range of 2.5 to 10 and a S/Mo mass ratio in a range of 10 to 25.

In another aspect, there is provided a method of reducing low speed pre-ignition events in a spark-ignited direct injection internal combustion engine comprising supplying to the engine the lubricating oil composition disclosed herein.

In a further aspect, there is provided an additive concentrate comprising from 80 to 20 wt. % of an organic liquid diluent and from 20 to 80 wt. % of any one of the embodiments described herein for the oil soluble polyester composition.

DETAILED DESCRIPTION

Introduction

In this specification, the following words and expressions, if and when used, have the meanings given below.

"Active ingredients" or "(a.i.)" or "actives" refers to additive material that is not diluent or solvent.

A "major amount" means in excess of 50 wt. % of a composition.

A "minor amount" means less than 50 wt. % of a composition, expressed in respect of the stated additive and in respect of the total weight of all the additives present in the composition, reckoned as active ingredient of the additive or additives.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

As used in connection with metallic detergents, the term "overbased" is used to designate metal salts in which the metal is present in stoichiometrically larger amounts than the organic radical.

The term "ppm" means parts per million by weight, based on the total weight of the lubricating oil composition.

"metal content" of the lubricating oil composition or the detergent component, for example magnesium content, calcium content or total metal content (i.e. the sum of all individual metal contents), is measured by ASTM D5185-09;

"TBN" means total base number, as determined in accordance with ASTM D2896. It is the amount of acid needed to neutralize all of the basicity of the material.

Sulfated ash was determined in accordance with ASTM D874.

Phosphorus, sulfur, molybdenum, magnesium and boron content were determined in accordance with ASTM D4951

All percentages reported are weight % on an active ingredient basis (i.e., without regard to carrier or diluent oil) unless otherwise stated.

All ASTM standards referred to herein are the most current versions as of the filing date of the present application.

Oil of Lubricating Viscosity

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecyl benzenes, tetradecylbenzenes, dinonylbenzenes, di(2-ethylhexyl)benzenes); polyphenols (e.g., biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkylmalonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622; ASTM D3120; ASTM D4294; or ASTM D4927.
[d]Determined in accordance with ASTM D2270.

Base oils for use herein are any of the variety corresponding to API Group I, Group II, Group III, Group IV and Group V oils and combinations thereof, more preferably API Group II, Group III, Group IV, and Group V oils, and combinations thereof, more preferably the Group III to Group V base oils and combinations thereof due to their exceptional volatility, stability, viscometric and cleanliness features.

The oil of lubricating viscosity constitutes the major component of the present lubricating oil composition is typically present is an amount ranging from greater than 50 to 99 wt. % (e.g., 70 to 95 wt. %, or 85 to 95 wt. %).

The oil of lubricating viscosity conveniently has a kinematic viscosity at 100° C. of 2.5 to 12 $mm^2/s$ (e.g., 3 to 10 $mm^2/s$, or 3.5 to 9 $mm^2/s$). Mixtures of synthetic and natural base oils may be used if desired.

Preferably, the volatility of the oil of lubricating viscosity, as measured by the NOACK test (ASTM D5800), is 20% or less (e.g., 16% or less, 12% or less, or 10% or less).

Preferably, the oil of lubricating viscosity has a viscosity index (VI) of at least 95 (e.g., at least 110, at least 120, at least 125, or 120 to 140).

Overbased Magnesium Detergent

The overbased (i.e., having a TBN of at least 150 mg KOH/g) magnesium detergent used herein can be any oil soluble or oil dispersible overbased magnesium detergent. Suitable overbased magnesium detergents include overbased magnesium sulfonates, phenates, salicylates, naphthenates and other magnesium aromatic organic carboxylates. Combinations of overbased magnesium detergents may be used (e.g., an overbased magnesium salicylate and an overbased magnesium sulfonate; or two or more magnesium detergents each having a different TBN of greater than 150 mg KOH/g). The overbased magnesium detergent is selected from one or more magnesium sulfonates, magnesium salicylates and magnesium phenates.

Preferably, the overbased magnesium detergent will have, or have on average, a TBN of at least 200 mg KOH/g (e.g., 200 to 500 mg KOH/g); at least 250 mg KOH/g (e.g., 250 to 500 mg KOH/g); or at least 300 mg KOH/g (e.g., 300 to 500 mg KOH/g).

In one embodiment the overbased magnesium detergent is a highly overbased magnesium sulfonate detergent having a TBN of at least 300 mg KOH/g (e.g., 350 to 500 mg KOH/g). For example, the highly overbased magnesium sulfonate detergent can be a highly overbased magnesium alkyltoluene sulfonate, such as described in U.S. Patent Application Publication No. 2011/0136711.

The overbased magnesium detergent is present in an amount sufficient to provide at least 600 ppm (e.g., 600 to 3000 ppm, 600 to 2000 ppm, 600 to 1500 ppm, 800 to 3000 ppm, 800 to 2000 ppm, 800 to 1500 ppm, 1000 to 3000 ppm, 1000 to 2000 ppm, 1200 to 3000 ppm, 1200 to 2000 ppm, or 1200 to 1750 ppm) of magnesium in the lubricating oil composition.

Boron-Containing Compound

The boron-containing compound used herein can be any oil-soluble or oil dispersible boron-containing compound. Suitable boron-containing compounds include borated dispersants, borated friction modifiers, dispersed alkali metal borate or a mixed alkali metal borate or an alkaline earth metal borate, borated sulfonates, and the like, and combinations thereof.

Examples of borated dispersants include borated ashless dispersants such as borated polyalkenyl succinic anhydrides; borated non-nitrogen containing derivatives of a polyalkylene succinic anhydride; borated basic nitrogen compounds selected from the group consisting of succinimides, carboxylic acid amides, hydrocarbyl monoamines, hydrocarbyl polyamines, Mannich bases, phosphonoamides, thiophosphonamides and phosphoramides, thiazoles (e.g., 2,5-dimercapto-1,3,4-thiadiazoles, mercaptobenzothiazoles and derivatives thereof), triazoles (e.g., alkyltriazoles and benzotriazoles), copolymers which contain a carboxylate ester with one or more additional polar function, including amine, amide, imine, imide, hydroxyl, carboxyl, and the like (e.g., products prepared by copolymerization of long chain alkyl acrylates or methacrylates with monomers of the above function); and the like and combinations thereof. A preferred borated dispersant is a succinimide derivative of boron such as, for example, a borated polyisobutenyl succinimide.

Examples of borated friction modifiers include borated fatty epoxides, borate esters, borated fatty amines, borated fatty amides, borated alkoxylated fatty amines, borated glycerol esters and the like and combinations thereof.

Examples of borated epoxides include borated epoxides obtained from the reaction product of one or more of the boron compounds with at least one epoxide. Suitable boron compounds include boron oxide, boron trifluoride, boron tribromide, boron trichloride, boron acids such as boronic acid, boric acid, tetraboric acid and metaboric acid, boron amides and various esters of boron acids. The epoxide is generally an aliphatic epoxide having from 10 to 22 carbon atoms. Suitable aliphatic epoxides include dodecene oxide, hexadecene oxide and the like and combinations thereof. Mixtures of epoxides may also be used, for instance commercial mixtures of epoxides having from 14 to 16 carbon atoms or from 14 to 18 carbon atoms. Borated epoxides are generally known and described in, for example, U.S. Pat. No. 4,584,115.

Examples of borate esters include those borate esters obtained by reacting one or more of the boron compounds disclosed above with one or more alcohols of suitable oleophilicity. Typically, the alcohols will contain from 10 to 22 carbon atoms. The methods of making such borate esters are well known in the art. The borate esters can also be borated phospholipids. Representative examples of borate esters include those having structures (1)-(3):

(1)

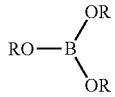

(2)

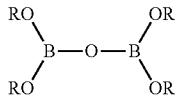

(3)

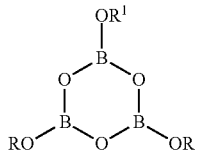

wherein each R is independently a $C_1$ to $C_{12}$ straight or branched alkyl group and $R^1$ is hydrogen or a $C_1$ to $C_{12}$ straight or branched alkyl group.

Examples of borated fatty amines include borated fatty amines obtained by reacting one or more of the boron compounds disclosed above with one or more of fatty amines, e.g., an amine having from 10 to 22 carbon atoms. The borated fatty amines may be prepared by reacting the amine with the boron compound at a temperature in a range of from 50° C. to 300° C. (e.g., from 100 to 250° C.) and at a ratio of from 3:1 to 1:3 equivalents of amine to equivalents of boron compound.

Examples of borated amides include borated amides obtained from the reaction product of a linear or branched, saturated or unsaturated monovalent aliphatic acid having from 10 to 22 carbon atoms, urea, and polyalkylenepolyamine with a boric acid compound and the like and combinations thereof.

Suitable borated glycerol esters include borated glycerol monoesters such as glycerol monooleate.

Examples of borated sulfonates include borated alkaline earth metal sulfonates obtained by (a) reacting in the presence of a hydrocarbon solvent (i) at least one of an oil-soluble sulfonic acid or alkaline earth sulfonate salt or mixtures thereof, (ii) at least one source of an alkaline earth metal; (iii) at least one source of boron, and (iv) from 0 to less than 10 mole percent, relative to the source of boron, of an overbasing acid, other than the source of boron; and (b) heating the reaction product of (a) to a temperature above the distillation temperature of the hydrocarbon solvent to distill the hydrocarbon solvent and water from the reaction. Suitable borated alkaline earth metal sulfonates include those disclosed in, for example, U.S. Pat. No. 7,981,846, the contents of which are incorporated by reference herein.

Hydrated particulate alkali metal borates are well known in the art and are available commercially. Representative examples of hydrated particulate alkali metal borates and methods of manufacture include those disclosed in, e.g., U.S. Pat. Nos. 3,313,727; 3,819,521; 3,853,772; 3,997,454;

4,089,790; 6,737,387; and 6,534,450. The hydrated alkali metal borates can be represented by the following Formula:

$$M_2O.mB_2O_3.nH_2O$$

where M is an alkali metal of atomic number in the range of about 11 to about 19, (e.g., sodium and potassium); m is a number from 2.5 to 4.5 (both whole and fractional); and n is a number from 1.0 to 4.8. Preferred are hydrated sodium borates. Hydrated borate particles generally have a mean particle size of less than about 1 micron.

The boron-containing compound is present in an amount sufficient to provide at least 250 ppm (e.g., 250 to 2000 ppm, 250 to 1000 ppm, 250 to 750 ppm, 300 to 2000 ppm, 300 to 1000, 300 to 750 ppm, or 300 to 600 ppm) of boron in the lubricating oil composition.

Molybdenum-Containing Compound

The molybdenum-containing compound can be any oil soluble or oil-dispersible molybdenum-containing compound. The oil-soluble or oil dispersible molybdenum-containing compound may have the functional performance of an antiwear agent, an antioxidant, a friction modifier, or any combination of these functions. The molybdenum compound may be mono-, di-, tri- or tetra-nuclear.

Examples of oil soluble or oil dispersible organo-molybdenum compounds include molybdenum-amine complexes, molybdenum dithiocarbamates, molybdenum dithiophosphates, molybdenum dithiophosphinates, molybdenum xanthates, thioxanthates, dispersed hydrated molybdenum compounds, and the like, and combinations thereof. In one embodiment, the molybdenum-containing compound is selected from one or more of molybdenum-amine complexes, molybdenum dithiocarbamates, and molybdenum dithiophosphates.

Molybdenum-amine complexes may be generally characterized as containing a molybdenum or molybdenum/sulfur complex of a basic nitrogen compound. The molybdenum compounds used to prepare the additives for compositions are acidic molybdenum compounds (e.g., molybdic acid, ammonium molybdate, sodium molybdate, potassium molybdate and other alkali metal molybdates and other molybdenum salts such as $MoOCl_4$, $MoO_2Br_2$, $Mo_2O_3Cl_6$, molybdenum trioxide or similar acidic molybdenum compounds). The basic nitrogen compound must have a basic nitrogen content as measured by ASTM D-664 or D-2896. Typical of such compositions are succinimides, carboxylic acid amides, hydrocarbyl monoamines, hydrocarbon polyamines, Mannich bases, phosphonamides, (thio)phosphonamides, dispersant viscosity index improvers, and combinations thereof. The molybdenum/nitrogen-containing complexes employed herein are well known in the art and are complexes of molybdic acid and an oil-soluble basic nitrogen-containing compound. Generally, the molybdenum/nitrogen-containing complex can be made with an organic solvent comprising a polar promoter during a complexation step and procedures for preparing such complexes are described, for example, in U.S. Pat. Nos. 4,259,194; 4,259,195; 4,261,843; 4,263,152; 4,265,773; 4,283,295; 4,285,822; 4,369,119; 4,370,246; 4,394,279; 4,402,840; 6,962,896; 8,022,022; 8,022,023; 8,076,275; 8,183,189; 8,193,131; 8,193,132; 8,426,608; 8,476,460; and 8,980,806; and U.S. Patent Application Publication Nos. 2013/0261313; 2014/0179573; and 2014/0018269. As shown in these references, the molybdenum/nitrogen-containing complex can further be sulfurized.

In one embodiment, the molybdenum-amine complex is a molybdenum-succinimide complex. Examples of succinimides include succinimides having an alkyl or alkenyl group of 8 of more carbon atoms (e.g., 8 to 400 carbon atoms). A succinimide having an alkyl or alkenyl group of greater than 30 to 400 carbon atoms may be used. However, the use of a succininimide having an alkyl or alkenyl group of 30 carbon atoms or less (e.g., 12 to 30 carbon atoms or 8 to 18 carbon atoms) can relatively increase the molybdenum content in the molybdenum-succinimide complex, enabling the advantageous effects of the present disclosure to be achieved even if the complex is added in a small amount.

One class of molybdenum dithiocarbamates useful herein is represented by the following structure (4):

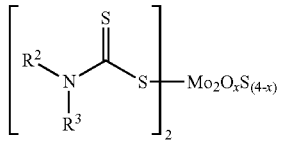

(4)

where $R^2$ and $R^3$ are alkyl groups having from 4 to 24 carbon atoms (e.g., 6 to 18 carbon atoms) and x is an integer from 0 to 4. $R^2$ and $R^3$ can be same or different. Examples of commercially available molybdenum dialkyldithiocarbamates include MOLYVAN® 807, MOLYVAN® 822 and MOLYVAN® 2000 sold by R.T. Vanderbilt (Norwalk, Conn.). Examples of commercially available molybdenum dithiocarbamates are available under the trade names SAKURA-LUBE® from Adeka Corporation and MOLYVAN® from Vanderbilt Chemicals. One example of a molybdenum dithiophosphate is molybdenum di-(2-ethylhexyl) phosporodithioate, available from Vanderbilt Chemicals as MOLYVAN® L.

One class of molybdenum dithiophosphates useful herein is represented by the following structure (5):

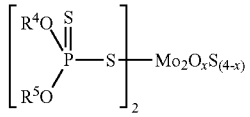

(5)

where $R^4$ and $R^5$ are alkyl groups having from 4 to 24 carbon atoms (e.g., 6 to 18 carbon atoms) and x is an integer from 0 to 4. $R^4$ and $R^5$ can be same or different. One example of a commercially available molybdenum dialkyldithiophosphate is MOLYVAN® L (molybdenum di-(2-ethylhexyl) phosphorodithioate) sold by R.T. Vanderbilt (Norwalk, Conn.).

Examples of dispersed hydrated molybdenum compounds include dispersed hydrated polymolybdates, dispersed hydrated alkali metal polymolybdates and the like and combinations thereof. Suitable dispersed hydrated polymolybdates include those disclosed in, for example, U.S. Pat. No. 7,884,058.

The molybdenum-containing compound can be used at concentrations to provide a molybdenum content of at least 50 ppm (e.g., 50 to 1000, 50 to 750 ppm, 50 to 250 ppm, or 100 to 750 ppm, 100 to 250 ppm) in the lubricating oil composition, based upon the total weight of the composition.

Lubricating Oil Composition

Preferably, the present lubricating oil composition is a multigrade oil identified by the viscometric descriptor SAE 0W-X, SAE 5W-X or SAE 10W-X, wherein X represents any one of 16, 20, 26, 30, 40, 50, and 60. The characteristics of the different viscometric grades can be found in the SAE J300 classification.

The present lubricating oil composition may contain conventional levels of sulfated ash. Preferably, the lubricating oil composition has a sulfated ash content of from greater than 1.0 wt. % to about 2.0 wt. %, preferably from 1.1 wt. % to 1.8 wt. %, more preferably from 1.1 wt. % to 1.6 wt. % based on the total weight of the composition.

Typically, the present lubricating oil composition contains more conventional levels of phosphorus. Suitably, the lubricating oil composition has phosphorus content of from about 0.07 wt. % to about 0.12 wt. %, or from about 0.075 wt. % to about 0.12 wt. % based on the total weight of the composition.

The present lubricating oil composition may contain more conventional levels of sulfur. The lubricating oil composition may have a sulfur content of 0.4 wt. % or less (e.g., 0.3 wt. % or less, or 0.2 wt. % or less based on the total weight of the composition. In one embodiment, the sulfur content of the lubricating oil composition is from about 0.2 wt. % to about 0.4 wt. %.

Suitably, the present lubricating oil composition may have a total base number (TBN) of 4 to 15 mg KOH/g (e.g., 5 to 12 mg KOH/g, 6 to 12 mg KOH/g, or 8 to 12 mg KOH/g).

The sulfur to molybdenum mass ratio (S/Mo ratio) in the lubricating oil composition can range from 10 to 25 (e.g., 10 to 20, 15 to 25, or 15 to 20).

The boron to molybdenum mass ratio (B/Mo ratio) in the lubricating oil composition can range from 2.5 to 10 (e.g., 2.5 to 8, 2.5 to 6, 2.5 to 5, 3 to 10, 3 to 8, or 3 to 5).

The lubricating oils of this disclosure provide excellent engine protection including anti-wear performance. This benefit can be demonstrated for the lubricating oils of this disclosure in the Sequence IVA (ASTM D6891), MB OM646LA (CEC L-99-08), and MB M271 engine tests.

The present lubricating oil compositions have a composition sufficient to pass wear protection requirements of one or more engine tests selected from Sequence IVA, OM646LA, M271 and others.

Additional Co-Additives

The present lubricating oil composition may additionally contain one or more of the other commonly used lubricating oil performance co-additives including dispersants, metal detergents, antiwear agents, antioxidants, friction modifiers, corrosion inhibitors, foam inhibitors, pour point depressants, viscosity modifiers, and others.

Dispersants

Dispersants maintain in suspension materials resulting from oxidation during engine operation that are insoluble in oil, thus preventing sludge flocculation and precipitation or deposition on metal parts. Dispersants useful herein include nitrogen-containing, ashless (metal-free) dispersants known to effective to reduce formation of deposits upon use in gasoline and diesel engines.

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also suitable are condensation products of polyamines and hydrocarbyl-substituted phenyl acids. Mixtures of these dispersants can also be used.

Basic nitrogen-containing ashless dispersants are well-known lubricating oil additives and methods for their preparation are extensively described in the patent literature. Preferred dispersants are the alkenyl succinimides and succinamides where the alkenyl-substituent is a long-chain of preferably greater than 40 carbon atoms. These materials are readily made by reacting a hydrocarbyl-substituted dicarboxylic acid material with a molecule containing amine functionality. Examples of suitable amines are polyamines such as polyalkylene polyamines, hydroxy-substituted polyamines and polyoxyalkylene polyamines.

Particularly preferred ashless dispersants are the polyisobutenyl succinimides formed from polyisobutenyl succinic anhydride and a polyalkylene polyamine such as a polyethylene polyamine of formula:

$$NH_2(CH_2CH_2NH)_zH$$

wherein z is 1 to 11. The polyisobutenyl group is derived from polyisobutene and preferably has a number average molecular weight ($M_a$) in a range of 700 to 3000 Daltons (e.g., 900 to 2500 Daltons). For example, the polyisobutenyl succinimide may be a bis-succinimide derived from a polyisobutenyl group having a $M_n$ of 900 to 2500 Daltons.

As is known in the art, the dispersants may be post-treated (e.g., with a boronating agent or a cyclic carbonate).

Nitrogen-containing ashless (metal-free) dispersants are basic, and contribute to the TBN of a lubricating oil composition to which they are added, without introducing additional sulfated ash.

Dispersants may be present at 0.1 to 10 wt. % (e.g., 2 to 5 wt. %) of the lubricating oil composition.

Metal Detergents

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a TBN of from 0 to 80 mg KOH/g. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of 150 mg KOH/g or greater, and typically will have a TBN of from 250 to 450 mg KOH/g or more.

A metal detergent in addition to the overbased magnesium detergent described above may be employed. Examples of suitable metal detergents include neutral and overbased salts of such substances as (a) lithium phenates, sodium phenates, potassium phenates, calcium phenates, sulfurized lithium phenates, sulfurized sodium phenates, sulfurized potassium phenates, and sulfurized calcium phenates, wherein each aromatic group has one or more aliphatic groups to impart hydrocarbon solubility; (b) lithium sulfonates, sodium sulfonates, potassium sulfonates, and calcium sulfonates, wherein each sulfonic acid moiety is attached to an aromatic nucleus which in turn usually contains one or more aliphatic substituents to impart hydrocarbon solubility; and (c) lithium salicylates, sodium salicylates, potassium salicylates, and calcium salicylates, wherein the aromatic moiety is usually substituted by one or more aliphatic substituents to impart hydrocarbon solubility; Mixtures of neutral or overbased salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

Metal detergents may be present at 1 to 6 wt. % (e.g., 2 to 5 wt. %) of the lubricating oil composition.

Antiwear Agents

Antiwear agents reduce wear of metal parts. Suitable anti-wear agents include dihydrocarbyl dithiophosphate metal salts such as zinc dihydrocarbyl dithiophosphates (ZDDP) of the formula:

$$Zn[S—P(=S)(OR')(OR'')]_2$$

wherein R' and R" may be the same of different hydrocarbyl radicals having from 1 to 18 (e.g., 2 to 12) carbon atoms and including radicals such as alkyl, alkenyl, aryl, arylalkyl, alkaryl and cycloaliphatic radicals. Particularly preferred as R' and R" groups are alkyl groups having from 2 to 8 carbon atoms (e.g., the alkyl radicals may be ethyl, n-propyl, isopropyl, n-butyl, isobutyl, sec-butyl, n-pentyl, isopentyl, n-hexyl, isohexyl, 2-ethylhexyl). In order to obtain oil solubility, the total number of carbon atoms (i.e., R' and R") will be at least 5. The zinc dihydrocarbyl dithiophosphate can therefore comprise zinc dialkyl dithiophosphates. Preferably, the zinc dialkyl dithiophosphate is a secondary zinc dialkyl dithiophosphate.

ZDDP may be present at 0.4 to 1.2 wt. % (e.g., 0.5 to 1.0 wt. %) of the lubricating oil composition.

Antioxidants

Antioxidants reduce the tendency of mineral oils during to deteriorate during service. Oxidative deterioration can be evidenced by sludge in the lubricant, varnish-like deposits on the metal surfaces, and by viscosity growth. Suitable antioxidants include hindered phenols, aromatic amines, and sulfurized alkylphenols and alkali and alkaline earth metals salts thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol; 4-methyl-2,6-di-tert-butylphenol; 4-ethyl-2,6-di-tert-butylphenol; 4-propyl-2,6-di-tert-butylphenol; 4-butyl-2,6-di-tert-butylphenol; and 4-dodecyl-2,6-di-tert-butylphenol. Other useful hindered phenol antioxidants include 2,6-di-alkyl-phenolic propionic ester derivatives such as IRGANOX® L-135 from Ciba and bis-phenolic antioxidants such as 4,4'-bis(2,6-di-tert-butylphenol) and 4,4'-methylenebis(2,6-di-tert-butylphenol).

Typical aromatic amine antioxidants have at least two aromatic groups attached directly to one amine nitrogen. Typical aromatic amine antioxidants have alkyl substituent groups of at least 6 carbon atoms. Particular examples of aromatic amine antioxidants useful herein include 4,4'-dioctyldiphenylamine, 4,4'-dinonyldiphenylamine, N-phenyl-1-naphthylamine, N-(4-tert-octyphenyl)-1-naphthylamine, and N-(4-octylphenyl)-1-naphthylamine.

Antioxidants may be present at 0.01 to 5 wt. % (e.g., 0.1 to 2 wt. %) of the lubricating oil composition.

Friction Modifiers

A friction modifier is any material that can alter the coefficient of friction of a surface lubricated by any lubricant or fluid containing such material. Suitable friction modifiers long chain fatty acid derivatives of amines, long chain fatty esters, or derivatives of a long chain fatty epoxides; fatty imidazolines; and amine salts of alkylphosphoric acids. As used herein, the term "fatty" means a carbon chain having 10 to 22 carbon atoms, typically a straight carbon chain.

Friction modifiers may be present at 0.01 to 5 wt. % (e.g., 0.1 to 1.5 wt. %) of the lubricating oil composition.

Corrosion Inhibitors

Corrosion inhibitors protect lubricated metal surfaces against chemical attack by water or other contaminants. Suitable corrosion inhibitors include polyoxyalkylene polyols and esters thereof, polyoxyalkylene phenols, thiadiazoles and anionic alkyl sulfonic acids. Such additives may be present at 0.01 to 5 wt. % (e.g., 0.1 to 1.5 wt. %) of the lubricating oil composition.

Foam Inhibitors

Foam control can be provided by many compounds including a foam inhibitor of the polysiloxane type (e.g., silicone oil or polydimethyl siloxane). Foam inhibitors may be present at less than 0.1 wt. % (e.g., 0.0001 to 0.01 wt. %) of the lubricating oil composition.

Pour Point Depressants

Pour point depressants lower the minimum temperature at which a fluid will flow or can be poured. Suitable pour point depressants include $C_8$ to $C_{18}$ dialkyl fumarate/vinyl acetate copolymers, polyalkylmethacrylates and the like. Such additives may be present at 0.01 to 5 wt. % (e.g., 0.1 to 1.5 wt. %) of the lubricating oil composition.

Viscosity Modifiers

Viscosity modifiers function to impart high and low temperature operability to a lubricating oil. The viscosity modifier used may have that sole function, or may be multifunctional. Multifunctional viscosity modifiers that also function as dispersants are also known. Suitable viscosity modifiers include polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene. Such additives may be present at 0.1 to 2 wt. % (e.g., 0.1 to 1 wt. %) of the lubricating oil composition.

Reduction of Low Speed Pre-Ignition Events

As indicated above, when operating a spark-ignited direct injection internal combustion engine at speeds less than or equal to 3000 rpm and under a load with a break mean effective pressure (BMEP) of greater than or equal to 10 bars, a low-speed pre-ignition (LSPI) event may occur in the engine. A LSPI event may consist of one or more LSPI combustion cycles, and generally consists of multiple LSPI combustion cycles which occur in a consecutive fashion or alternating fashion with normal combustion cycles in between. Without being bound to a particular theory, LSPI may result from a combustion of oil droplet(s), or a droplet(s) of oil-fuel mixture, or combinations thereof, which may accumulate, for example, in the top land crevices volume of a piston, or the piston ring-land and ring-groove crevices. The lubricant oil may be transferred from below the oil control ring to the piston top land area due to unusual piston ring movements. At low speed, high load conditions, in-cylinder pressures dynamics (compression and firing pressures) may be considerably different from in-cylinder pressures at lower loads, particularly due to strongly retarded combustion phasing and high boost and peak compression pressures which can influence ring motion dynamics.

At the foregoing loads, LSPI, which may be accompanied by subsequent detonation and/or severe engine knock, can cause severe damage to the engine very quickly (often within 1 to 5 engine cycles). Engine knock may occur with LSPI given that, after the normal spark from the igniter is provided, multiple flames may be present. The present disclosure aims to provide a method for inhibiting or reducing LSPI events, the method involving supplying to the engine the present lubricating oil composition.

In one embodiment, the engine is operated at speeds between 500 and 3000 rpm (e.g., 800 rpm to 2800 rpm, or 1000 rpm to 2600 rpm). Additionally, the engine may be operated with a break mean effective pressure of 10 to 30 bars (e.g., 12 to 24 bars).

LSPI events, while comparatively uncommon, may be catastrophic in nature. Hence drastic reduction or even elimination of LSPI events during normal or sustained operation of a direct fuel injection engine is desirable. In one embodiment, the presently disclosed method is such that there are less than 20 (e.g., less than 10, less than 5, or even 0) LSPI events per 100,000 combustion events.

In one embodiment, the method of the invention provides a reduction in the number of LSPI events of at least 10% (e.g., at least 20%, at least 30%, or at least 50%.

Wear Protection

The present lubricating oil composition also provides excellent wear protection in internal combustion engines. For example, the present lubricating oil composition may be sufficient to meet the wear protection requirements of one or more engine tests selected from Sequence IVA, OM646LA and M271.

EXAMPLES

The following illustrative examples are intended to be non-limiting.

Example 1

A lubricating oil composition was prepared by blending together the following components to obtain an SAE 5W-30 viscosity grade formulation:

(a) 770 ppm, in terms of phosphorus content, of a secondary zinc diaklyldithiophosphate;
(b) 1410 ppm, in terms of magnesium content, of a highly overbased magnesium sulfonate detergent;
(c) 470 ppm, in terms of boron content, of a combination of a borated glycerol monooleate and a borated sulfonate;
(d) 130 ppm, in terms of molybdenum content, of a molybdenum-succinimide complex;
(e) succinimide dispersant;
(f) calcium phenate;
(g) an alkylated diphenylamine antioxidant;
(h) conventional amounts of pour point depressant, viscosity index improver, and foam inhibitor; and
(i) the balance a mixture of Group III base oils.

Example 2

A lubricating oil composition was prepared by blending together the following components to obtain an SAE 5W-30 viscosity grade formulation:

(a) 990 ppm, in terms of phosphorus content, of a secondary zinc diaklyldithiophosphate;
(b) 1000 ppm, in terms of magnesium content, of a highly overbased magnesium sulfonate detergent;
(c) 470 ppm, in terms of boron content, of a combination of a borated glycerol monooleate and a borated sulfonate;
(d) 150 ppm, in terms of molybdenum content, of a molybdenum-succinimide complex;
(e) succinimide dispersant;
(f) calcium phenate;
(g) an alkylated diphenylamine antioxidant;
(h) conventional amounts of pour point depressant, viscosity index improver, and foam inhibitor; and
(i) the balance a mixture of Group III base oils.

Comparative Example 1

A magnesium-free lubricating oil composition was prepared by blending together the following components to obtain an SAE 10W-60 viscosity grade formulation:

(a) 1120 ppm, in terms of phosphorus content, of a secondary zinc diaklyldithiophosphate;
(b) 550 ppm, in terms of boron content, of a combination of a borated bis-succinimide dispersant, a borated glycerol monooleate and a borated sulfonate;
(c) 180 ppm, in terms of molybdenum content, of a molybdenum-succinimide complex;
(d) a succinimide dispersant;
(e) calcium phenate;
(f) mixture of calcium sulfonates;
(g) an alkylated diphenylamine antioxidant;
(h) conventional amounts of pour point depressant, viscosity index improver, and foam inhibitor; and
(i) the balance a mixture of Group III base oils.

Comparative Example 2

A magnesium-free lubricating oil composition was prepared as described in Comparative Example 1 except that that the composition had a molybdenum content of 90 ppm and a boron content of 530 ppm.

Comparative Example 3

A magnesium-free lubricating oil composition was prepared as described in Comparative Example 1 except that that the composition had a molybdenum content of 140 ppm and a boron content of 540 ppm.

Comparative Example 4

A magnesium-free lubricating oil composition was prepared as described in Comparative Example 1 except that that the composition had a boron content of 530 ppm.

Comparative Example 5

A lubricating oil composition was prepared by blending together the following components to obtain an SAE 5W-30 viscosity grade formulation:

(a) 1000 ppm, in terms of magnesium content, of a highly overbased magnesium sulfonate detergent;
(b) 990 ppm, in terms of phosphorus content, of a secondary zinc diaklyldithiophosphate;
(c) 470 ppm, in terms of boron content, of a combination of a borated glycerol monooleate and a borated sulfonate;
(d) 50 ppm, in terms of molybdenum content, of a molybdenum-succinimide complex;
(e) a succinimide dispersant;
(f) calcium phenate;
(g) an alkylated diphenylamine antioxidant;

(h) conventional amounts of pour point depressant, viscosity index improver, and foam inhibitor; and
(i) the balance a mixture of Group III base oils.

Comparative Example 6

A magnesium-free lubricating oil composition was prepared by blending together the following components to obtain an SAE 5W-30 viscosity grade formulation:
(a) 1120 ppm, in terms of phosphorus content, of a secondary zinc diaklyldithiophosphate;
(b) 530 ppm, in terms of boron content, of a combination of a borated bis-succinimide dispersant, a borated glycerol monooleate and a borated sulfonate;
(c) 90 ppm, in terms of molybdenum content, of a molybdenum-succinimide complex;
(d) A succinimide dispersant;
(e) calcium phenate;
(f) mixture of calcium sulfonates;
(g) an alkylated diphenylamine antioxidant;
(h) conventional amounts of pour point depressant, viscosity index improver, and foam inhibitor; and
(i) the balance a mixture of Group II and III base oils.

TESTING

Performance evaluation of the formulations is given in Table 1. The following engine tests were performed to measure wear: Sequence IVA (ASTM D6891), OM646LA (CEC L-99-08) and MB M271.

The Sequence IVA test evaluates a lubricant's performance in preventing camshaft lobe wear in an overhead camshaft engine. More specifically, the test measures the ability of crankcase oil to control camshaft lobe wear for spark-ignition engines equipped with an overhead valvetrain and sliding can followers. This test is to simulate service for taxicab, light-delivery truck, or commuter vehicles. Pass/fail criteria include average cam wear of 90 μm maximum for GF-4/5.

The Sequence IVA test method is a 100-hour test involving 100 hourly cycles; each cycle consists of two operating modes or stages. Unleaded "Haltermann KA24E Green" fuel is used. The text fixture is a KA24E Nissan 2.4-liter, water-cooled, fuel-injected engine, 4-cylinder in-line, overhead camshaft with two intake valves, and one exhaust valve per cyclinder.

While the Sequence IVA test is the key wear test in the API test sequences, it is not applicable for European ACEA specifications. The key engine wear test for ACEA specifications is the diesel OM646LA test.

OM646LA is a 300 hour cyclic test uses a 4 cylinder 2.2 L diesel OM646 DE 22 LA engine to evaluate engine lubricant performance with respect to engine wear and overall cleanliness, as well as piston cleanliness and ring sticking, under severe operating conditions. The primary result is cam wear, although bore polish, cylinder wear and tappet wear may also be measured.

Low Speed Pre-Ignition (LSPI) events were measured in a Ford 2.0 L EcoBoost® engine. This engine is a turbocharged gasoline direct injection (GDI) engine. The Ford Ecoboost engine is operated in four 4 hour runs. The engine is operated at 1750 rpm and 1.7 MPa break mean effective pressure (BMEP) with an oil sump temperature of 95° C. The engine is run for 175,000 combustion cycles in each stage (first 170,000 valid engine cycles), and LSPI events are counted.

LSPI events are determined by monitoring peak cylinder pressure (PP) and mass fraction burn (MFB) of the fuel charge in the cylinder. When either or both criteria are met, it can be said that an LSPI event has occurred. The threshold for peak cylinder pressure varies by test, but is typically 4-5 standard deviations above the average cylinder pressure. Likewise, the MFB threshold is typically 4-5 standard deviations earlier than the average MFB (represented in crank angle degrees). LSPI events can be reported as events per 100,000 combustion cycles, events per cycle, and/or combustion cycles per event.

TABLE 2

| | Ex. 1 | Ex. 2 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| SAE Viscosity Grade | 5W-30 | 5W-30 | 10W-60 | 10W-60 | 10W-60 | 10W-60 | 5W-30 | 5W-30 |
| Mg, ppm | 1410 | 1000 | 0 | 0 | 0 | 0 | 1000 | 0 |
| Mo, ppm | 130 | 150 | 180 | 90 | 140 | 140 | 50 | 90 |
| B, ppm | 470 | 470 | 550 | 530 | 540 | 530 | 470 | 530 |
| B/Mo Mass Ratio | 3.62 | 3.13 | 3.06 | 5.89 | 3.86 | 3.79 | 9.4 | 5.89 |
| S/Mo Mass Ratio | 17.8 | 18.5 | 16.9 | 33.7 | 21.7 | 21.7 | 55.4 | 35.1 |
| P, ppm | 770 | 990 | 1120 | 1120 | 1120 | 1120 | 990 | 1120 |
| S, ppm | 2320 | 2770 | 3040 | 3030 | 3040 | 3040 | 2770 | 3160 |
| Sulfated Ash, wt. % | 1.22 | 1.23 | 1.36 | 1.36 | 1.36 | 1.36 | 0.22 | 1.4 |
| | | | Seq. IVA Test (ASTM 6891) | | | | | |
| Ave. Cam Wear, μm | 14.89 | 43.75 | 23.24 | 104.61 | 82.66 | 62.67 | 122.77 | |
| Seq. IVA Pass/Fail(1) | Pass | Pass | Pass | Fail | Pass | Pass | Fail | |
| | | | OM646LA Test (CEC L-99-08) | | | | | |
| Ave. Outlet Cam Wear, μm | 54 | | | | | | | 119.2 |
| OM646LA Pass/Fail(2) | Pass | | | | | | | Fail |
| | | | M271 Test | | | | | |
| Ave. Outlet Cam Wear, μm | 2.1 | | | | | | | 1.4 |
| Ave. Radial P-Ring Wear Ring 1, μm | 2.8 | | | | | | | 5.3 |

TABLE 2-continued

| | Ex. 1 | Ex. 2 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Ave. Conrod Bearings Wear, μm | 0.2 | | | | | | | 2.9 |
| Max. Conrod Bearings Wear, μm | 0.5 | | | | | | | 4.5 |
| M271 Pass/Fail[3] | Pass | | | | | | | Fail |
| | | | Ford LPSI Test | | | | | |
| Peak Pressure Only (PP), avg. | 0.25 | 0 | 0.25 | | | | | |
| MFB2 only, avg. | 0.25 | 0.50 | 1.75 | | | | | |
| Both, avg. | 3.25 | 0.25 | 6.25 | | | | | |
| Total, avg. | 3.75 | 0.75 | 8.25 | | | | | |

[1]Sequence IVA pass/fail criteria include an average cam wear of 90 μm maximum for GF-4/5.

[2]OM646LA pass/fail criteria include an average outlet cam wear of 110 μm maximum.

[3]M271 pass/fail criteria include: an average outlet cam wear of 5.0 μm maximum; an average radial P-ring wear on ring 1 of 5 μm maximum; an average conrod bearings wear of 1.5 μm maximum; and a maximum conrod bearings wear of 3.5 μm maximum.

The disclosure of all patents, articles or other materials described herein are hereby incorporated, in their entirety, into this specification by reference.

The invention claimed is:

1. A method of improving wear protection in an internal combustion engine comprising supplying to the engine a lubricating oil composition having a sulfated ash content of from about 1.1 to about 1.6 wt. %, a phosphorus content of from about 0.07 to about 0.12 wt. %, and a sulfur content of from about 0.2 to about 0.4 wt. %, the lubricating oil composition comprising:

(a) an oil of lubricating viscosity in a major amount;

(b) an overbased magnesium detergent, in an amount providing the lubricating oil composition with about 600 to 1500 ppm of magnesium, based on the total weight of the lubricating oil composition;

(c) a boron-containing compound, in an amount providing the lubricating oil composition with about 300 to 750 ppm of boron, based upon the total weight of the composition; and (d) a molybdenum-containing compound, in an amount providing the lubricating oil composition with at least about 100 ppm of molybdenum, based upon the total weight of the composition, wherein the composition has a B/Mo mass ratio in a range of 3 to 8 and a S/Mo mass ratio in a range of 15 to 20, and wherein the lubricating oil composition is sufficient to pass wear protection requirements of one or more engine tests selected from Sequence IVA, OM646LA, and M271.

2. The method of claim 1, wherein the overbased magnesium detergent is selected from one or more of magnesium sulfonates, magnesium salicylates and magnesium phenates.

3. The method of claim 1, wherein the overbased magnesium detergent is a magnesium sulfonate.

4. The method of claim 3, wherein the magnesium sulfonate has a TBN of at least 300 mgKOH/g.

5. The method of claim 1, wherein the boron-containing compound is selected from one or more of borated dispersants, borated friction modifiers, dispersed alkali metal borate or a mixed alkali metal borate or an alkaline earth metal borate, and borated sulfonates.

6. The method of claim 1, wherein the molybdenum-containing compound is selected from one or more of molybdenum-amine complexes, molybdenum dithiocarbamates, and molybdenum dithiophosphates.

7. The method of claim 6, wherein the molybdenum-amine complex is a molybdenum-succinimide complex.

8. The method of claim 1, further comprising one or more co-additives in a minor amount, other than additive components (b), c) and (d), selected from ashless dispersants, metal detergents, antiwear agents, antioxidants, friction modifiers, corrosion inhibitors, foam inhibitors, pour point depressants, and viscosity modifiers.

* * * * *